US009637958B2

(12) United States Patent
Vanderick

(10) Patent No.: US 9,637,958 B2
(45) Date of Patent: May 2, 2017

(54) DEVICE FOR UNLOCKING A DOOR

(76) Inventor: Frans J. R. Vanderick, Halen (BE)

( * ) Notice: Subject to any disclaimer, the term of this patent is extended or adjusted under 35 U.S.C. 154(b) by 453 days.

(21) Appl. No.: 14/349,715

(22) PCT Filed: Aug. 8, 2012

(86) PCT No.: PCT/BE2012/000040
§ 371 (c)(1),
(2), (4) Date: May 14, 2014

(87) PCT Pub. No.: WO2013/049899
PCT Pub. Date: Apr. 11, 2013

(65) Prior Publication Data

US 2014/0252781 A1 Sep. 11, 2014

(30) Foreign Application Priority Data

Oct. 5, 2011 (BE) ..... 2011/0582

(51) Int. Cl.
*E05C 1/08* (2006.01)
*E05B 63/22* (2006.01)
(Continued)

(52) U.S. Cl.
CPC ..... *E05C 1/08* (2013.01); *E05B 63/22* (2013.01); *E05B 65/102* (2013.01); *E05C 3/08* (2013.01);
(Continued)

(58) Field of Classification Search
CPC ..... E05B 63/22; E05B 65/102; E05C 1/08; E05C 1/14; E05C 3/08; E05C 3/122; Y10S 292/31
(Continued)

(56) References Cited

U.S. PATENT DOCUMENTS 357,084 A * 2/1887 Hollenbeck ..... E05B 85/22 292/164
644,255 A * 2/1900 Meyer ..... E05B 1/0038 292/168
(Continued)

FOREIGN PATENT DOCUMENTS

CH 154751 A * 5/1932 ..... E05C 1/14
CH 191794 A 7/1937
(Continued)

OTHER PUBLICATIONS

International Search Report and Written Opinion of the International Searching Authority Oct. 18, 2012 (7 pages).

*Primary Examiner* — Carlos Lugo
(74) *Attorney, Agent, or Firm* — Andrew J. Anderson, Esq.; Harter Secrest & Emery LLP

(57) ABSTRACT

Device for unlocking a door, comprising at least one operating element; a bolt; a coupling which can be placed in the door and which is coupled between the bolt and the operating element, wherein the coupling comprises a pair of scissor arms mounted rotatably around a fixed shaft, and a pair of pivot arms, wherein each pivot arm is connected at a first end for pivoting around a first shaft to a scissor arm and connected at a second end for pivoting around a second shaft to a push part intended to engage against the bolt, such that a tilting of the operating element brings about a movement of the push part, and thus of the bolt.

20 Claims, 2 Drawing Sheets

(51) Int. Cl.

| | |
|---|---|
| ***E05B 65/10*** | (2006.01) |
| ***E05C 3/08*** | (2006.01) |
| ***E05C 3/12*** | (2006.01) |
| *E05C 1/12* | (2006.01) |

(52) U.S. Cl.
CPC ..... *E05C 3/122* (2013.01); *Y10S 292/31* (2013.01); *Y10T 292/097* (2015.04); *Y10T 292/102* (2015.04)

(58) Field of Classification Search
USPC ..... 292/92–94, 97, 123, 139, 163, 164, 292/166–168, 196, 221–223
See application file for complete search history.

(56) References Cited

U.S. PATENT DOCUMENTS 766,253 A * 8/1904 Howe ..... E05B 63/0017 105/282.1
842,299 A * 1/1907 Cassity ..... E05B 85/22 292/167
1,071,862 A * 9/1913 Becker ..... E05B 85/24 292/2
1,120,538 A * 12/1914 Richardson ..... E05B 65/1073 292/221
1,238,042 A * 8/1917 Moore ..... E05B 63/0017 292/139
1,593,435 A * 7/1926 Carter ..... E05C 9/046 292/35
1,908,980 A * 5/1933 Heyel ..... E05B 63/126 292/34
1,995,889 A * 3/1935 Landry ..... E05B 65/0003 292/45
2,497,624 A * 2/1950 Nelson ..... E05C 1/145 292/166
2,784,993 A 3/1957 Collar
3,633,953 A * 1/1972 Gley ..... E05C 1/14 292/166
3,765,709 A * 10/1973 Van Wyck ..... E05B 63/24 292/144
3,869,161 A * 3/1975 Meroni ..... E05B 55/005 292/166
3,909,051 A * 9/1975 Nakai ..... E05C 1/166 292/153
4,083,590 A * 4/1978 Folger ..... E05B 65/1053 292/168
4,243,090 A * 1/1981 Kemp ..... E06B 9/063 160/145
4,669,773 A * 6/1987 LeVee ..... B60P 3/34 292/7
4,741,563 A * 5/1988 Cohrs ..... E05B 65/1046 292/168
4,941,334 A * 7/1990 Fish ..... E05B 37/16 292/139
4,951,486 A * 8/1990 Braun ..... E05B 13/002 292/DIG. 31
4,968,070 A * 11/1990 Choi ..... E05B 65/1053 292/92
5,235,723 A * 8/1993 Wallis ..... E05F 1/16 16/71
5,490,696 A * 2/1996 Hutson ..... E05B 65/1073 292/139
5,564,759 A * 10/1996 McNutt ..... E05B 1/0053 292/139
6,061,965 A * 5/2000 Schrock ..... E05F 15/56 49/360
6,152,516 A * 11/2000 Williams ..... B60J 7/1265 296/136.03
6,364,392 B1 * 4/2002 Meinke ..... B62D 33/0273 296/26.1
6,397,646 B1 * 6/2002 Doong ..... E05B 47/0012 70/275
6,899,362 B1 * 5/2005 Weinerman ..... E05B 13/105 292/336.3
7,281,748 B2 * 10/2007 Ruhlander ..... B62D 33/0273 292/144
7,308,973 B2 * 12/2007 Dziwak ..... B66B 13/06 160/84.09
8,100,363 B2 * 1/2012 Ponsart ..... B64C 1/1446 244/129.4
2004/0261475 A1 * 12/2004 Artsiely ..... E05B 47/023 70/107
2009/0071520 A1 * 3/2009 Sy-Facunda ..... E04H 15/14 135/93

FOREIGN PATENT DOCUMENTS

CH 203907 A * 4/1939 ..... E05C 1/14
CH 247400 A * 3/1947 ..... E05C 1/14
EP 1741858 A1 1/2007
FR 1136148 A * 5/1957 ..... E05B 5/00
GB 451978 A * 8/1936 ..... E05C 1/14
GB 1197893 A * 7/1970 ..... E05C 1/14

* cited by examiner

DEVICE FOR UNLOCKING A DOOR

FIELD OF INVENTION

The present invention relates to a device for unlocking a door, comprising at least one operating element which can be employed by a user for the purpose of opening the door, a bolt movable between a locking position and an opening position of the door, and a coupling which can be placed in the door and which is coupled between the bolt and the operating element for causing a movement of the bolt from the locking position to the opening position upon activation of an operating element.

BACKGROUND OF THE INVENTION

Such a device is for instance known from EP 1 741 858 A1 in the name of applicant. Inside doors are typically equipped with a spring-mounted bolt which can be moved from a locking position to an opening position by means of a doorhandle. Doors are further available on the market which are provided with a press element which is electronically connected to a locking element such that the door can be opened by simply pressing a button.

The present invention has for its object to provide a simple and robust device of the type stated in the preamble which can be fitted better into an inside door, in particular a door of a limited thickness, as an alternative to a doorhandle.

SUMMARY OF THE INVENTION

For this purpose an embodiment of the device according to the invention is distinguished in that the coupling comprises a pair of scissor arms mounted rotatably around a fixed shaft and a pair of pivot arms. Each pivot arm is connected at a first end for pivoting around a respective first shaft to a corresponding scissor arm and connected at a second end for pivoting around a second shaft to a push part intended to engage against the bolt. The fixed shaft and first and second shafts are parallel and are intended to extend in a plane substantially parallel to the door, this such that a tilting of the operating element brings about a movement of the push part, which movement of the push part brings about a movement of the bolt.

Through the use of such scissor arms and pivot arms a very slender device can be obtained by moving the scissor arms (and so also the pivot arms) toward each other. In this extended position the device can be easily inserted and fitted into a recess in the door, even if the door is relatively thin.

Further developed possible embodiments are described in the appended dependent claims.

According to an advantageous embodiment, the device further comprises a housing which is intended for insertion into a recess in the door, wherein the fixed shaft is fixedly mounted in the housing and the second shaft is mounted for movement in a guide in the housing. This guide can for instance be formed by a recess in the housing.

According to an advantageous embodiment, each operating element takes the form of a flap positioned pivotally on one side in the housing. The flap preferably extends in a plane substantially parallel to the fixed shaft and the first and second shafts and is tiltable in the direction of these shafts.

According to another aspect of the invention, a device is provided comprising at least one operating element, a bolt movable between a locking position and an opening position of the door, and a coupling which can be placed in the door and which is coupled between the bolt and the operating element for causing a movement of the bolt from the locking position to the opening position upon activation of an operating element, wherein the at least one operating element comprises a first operating element and a second operating element which extend on either side of the coupling and are intended to be built into opposite sides of the door. The first operating element is tiltable around a first tilting shaft and the second operating element is tiltable around a second tilting shaft parallel to the first tilting shaft, the first and second tilting shafts being spring-mounted relative to each other, this such that these tilting shafts are movable toward each other during placing of the device in the door and can move with spring action away from each other for the purpose of positioning the device in the door. The device can in this way be positioned in simple manner in a recess in a door.

According to an advantageous embodiment hereof, the first and the second operating element are each connected by means of a spring-mounted arm to a housing in which the coupling is received. These spring-mounted arms can for instance be resiliently suspended from a fixed shaft intended for placing parallel to the plane of the door.

According to an embodiment, the invention provides an assembly which consists of three parts and which co-acts in moving a mechanism, such as a lock of a door, out of the locked position. The pressing/pulling movement of a user is converted in effective manner into a scissor movement of the coupling and a movement of the bolt. The bolt is preferably tiltable, but can also be slidable. The tilting movement of the coupling element is then converted to a sliding movement.

The operating element preferably operates the coupling through a direct coupling. A pushing movement results in a tilting of the operating element and thus in a scissor movement of the coupling.

BRIEF DESCRIPTION OF THE DRAWINGS

Other features and advantages will become apparent from the description of a number of non-limitative exemplary embodiments with reference to the accompanying drawings, in which.

DETAILED DESCRIPTION OF THE INVENTION

Figure 1A:
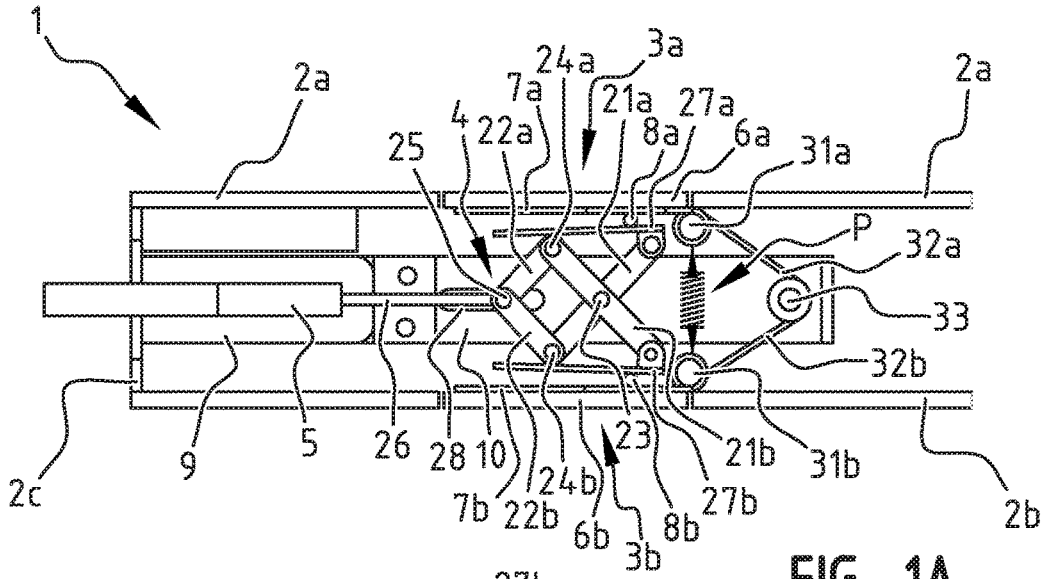
FIGS. 1A and 1B show schematically respectively a top view and a cross-section of a first embodiment of a device according to the invention in the locking position.

FIGS. 1A-B and 2A-B show a door 1 with a first wall 2*a*, an opposite second wall 2*b* and a side wall 2*c*. Arranged in door 1 is a first embodiment of a device according to the invention. An operating element 3*a*, 3*b* is built into each wall 2*a*, 2*b* of the door, although it is also possible to provide an operating element in only one wall.

The device has a frame which is formed here for instance by a first housing 9 for a bolt 5 and a second housing 10 for a coupling 4 for coupling the operating element 3*a*, 3*b* to bolt 5. The diverse shafts for tilting and/or spring means for biasing can be mounted in housing 10. Housing 10 with coupling 4 and operating elements 3*a*, 3*b* can be placed integrally in a lock opening of door 1. Only the outer flaps 6*a*, 6*b* of operating elements 3*a*, 3*b* are typically placed later, i.e. after insertion of housing 10 with inner flap 7*a*, 7*b*. Note in this respect that outer flap 6*a*, 6*b* is typically dimensioned to fit into a recess of the door, while inner flap 7*a*, 7*b* is typically dimensioned to be larger than the recess in the door such that it supports against an inner side of wall 2*a*, 2*b* of the door.

Coupling 4 comprises a pair of scissor arms 21*a*, 21*b* mounted rotatably around a fixed shaft 23 and a pair of pivot arms 22*a*, 22*b*. Each pivot arm 22*a*, 22*b* is connected at a first end for pivoting around a corresponding first shaft 24*a*, 24*b* to a corresponding scissor arm 21*a*, 21*b* and is connected at a second end for pivoting around a second shaft 25 to a push part, here in the form of a pin 26. Note that the second shaft is common here to pivot arms 22*a* and 22*b*, but that it would also be possible to connect pivot arm 22*a* around a second shaft to the push part and to connect pivot arm 22*b* around another parallel second shaft to the push part. Push pin 26 is intended to engage against bolt 5. Fixed shaft 23 and the first and second pivot shafts 24*a*, 24*b*, 25 are parallel and extend in a plane substantially parallel to door 1. A tilting of an operating element 3*a*, 3*b* will thus bring about a movement of push part 26 which in turn brings about a movement of the bolt, see FIGS. 2A-B. The use of scissor arms 21*a*,21*b* and pivot arms 22*a*,22*b* has the advantage that the coupling is very slender when the scissor arms are moved toward each other, whereby coupling 4 can be inserted in doors of a limited thickness.

Fixed shaft 23 is mounted fixedly in housing 10, and second shaft 25 is guided in a guide in the form of a slot-like opening 28 in housing 10.

Operating element 3*a*, 3*b* takes the form here of a flap which is mounted in the plane of the door and which is built into the door for pivoting around a tilting shaft 31*a*, 31*b* parallel to the plane of the door. Each operating element is more particularly suspended pivotally on one side from the housing and formed from an inner flap 7*a*, 7*b* and an outer flap 6*a*, 6*b* which extend in a plane substantially parallel to fixed shaft 23 and the first and second pivot shafts 24*a*, 24*b*, 25.

The first operating element is tiltable around a first tilting shaft 31*a* and the second operating element is tiltable around a second tilting shaft 31*b* which is parallel to the first tilting shaft. The first and second tilting shafts are spring-mounted relative to each other, see the schematic arrow P in FIG. 1A. These tilting shafts are in this way movable toward each other during placing of the device in the door and can move with spring action away from each other for the purpose of positioning the device in the door. This can for instance be realized by connecting each of the first and the second operating element by means of a spring-mounted arm 32*a*, 32*b* to the housing. These arms 32*a*, 32*b* can for instance be spring-mounted around a fixed shaft 33 arranged in housing 10. Note that fixed shaft 33 could also be situated on the other side of tilting shafts 31*a*, 31*b*, close to fixed shaft 23, in order to thus obtain an even more compact device.

Each operating element 3*a*, 3*b* is provided with a respective pin 8*a*, 8*b* which co-acts with a press plate 27*a*, 27*b*. Pin 8*a*, 8*b* is arranged such that activation of the operating mechanism carries the coupling 4 from a rest position to an activated position, wherein scissor arms 21*a*, 21*b* move toward each other and pivot arms 22*a*, 22*b* move toward each other such that push part 26 moves in the direction of bolt 5. Each scissor arm 21*a*, 21*b* is connected at a first end to the first end of the respective pivot arm 22*a*, 22*b* and is pivotally connected at a second end to press plate 27*a*, 27*b*, wherein in the activated position the operating mechanism engages against this press plate in order to move the scissor arms toward each other.

In the shown embodiment the operating element is a push element. The user can unlock the door by pushing against flap 3*a*, 3*b*, for instance by hand. The door can here also be pulled/opened toward the user. Displacing the flap 3*a*, 3*b* in fact creates a handgrip which is not visible in the starting position.

Figure 1B:
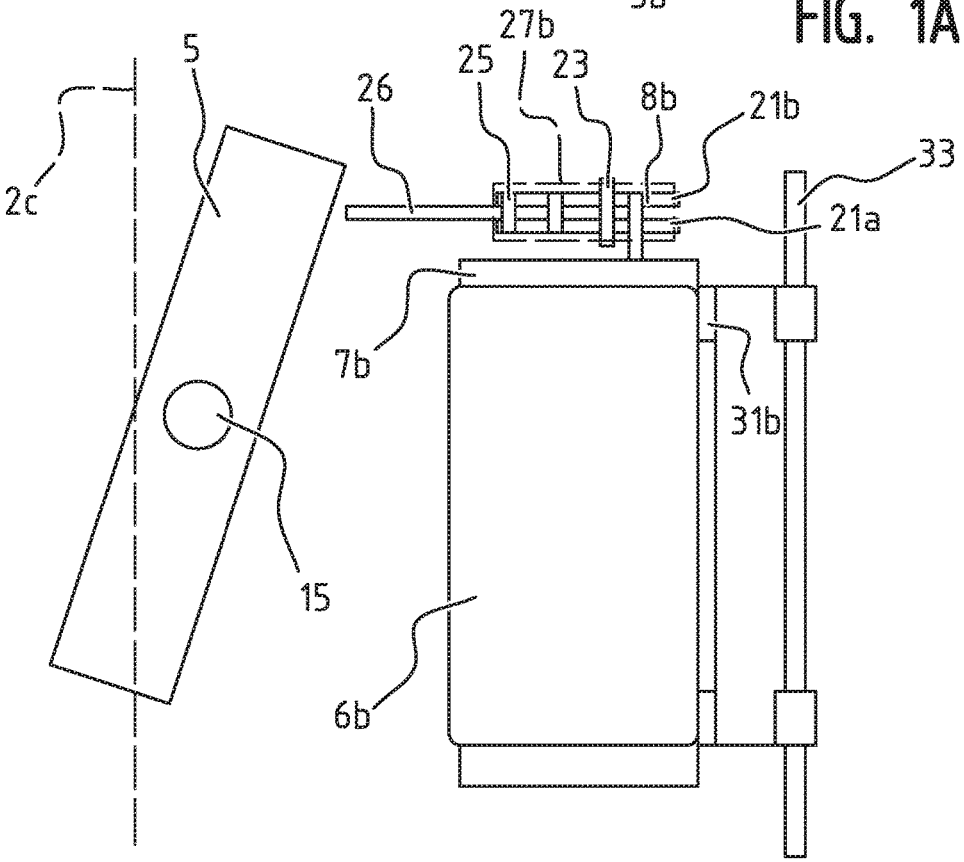
Figure 2A:
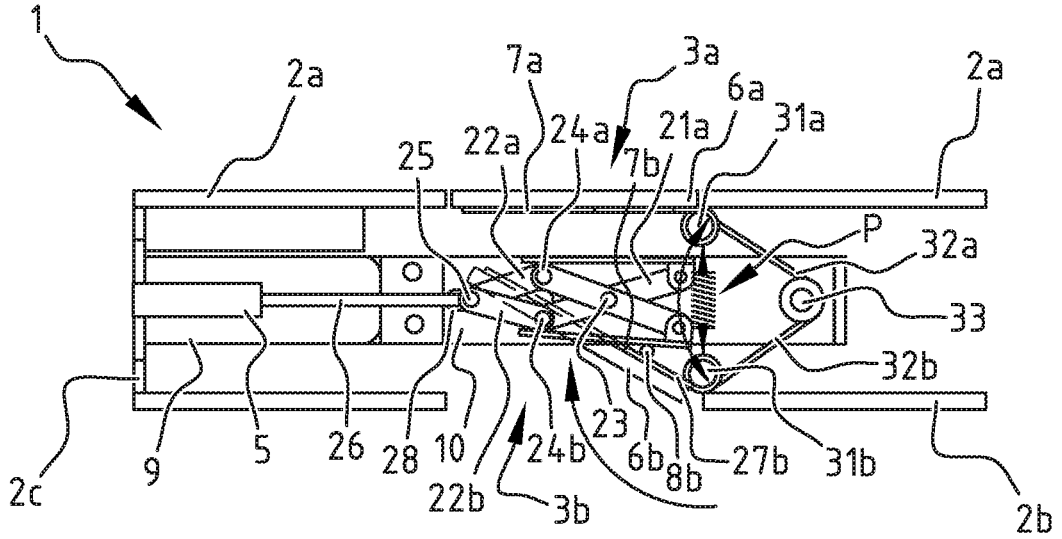
FIGS. 2A and 2B show schematically respectively a top view and a cross-section of the first embodiment of FIG. 1 in the activated position of an operating element.
Figure 2B:
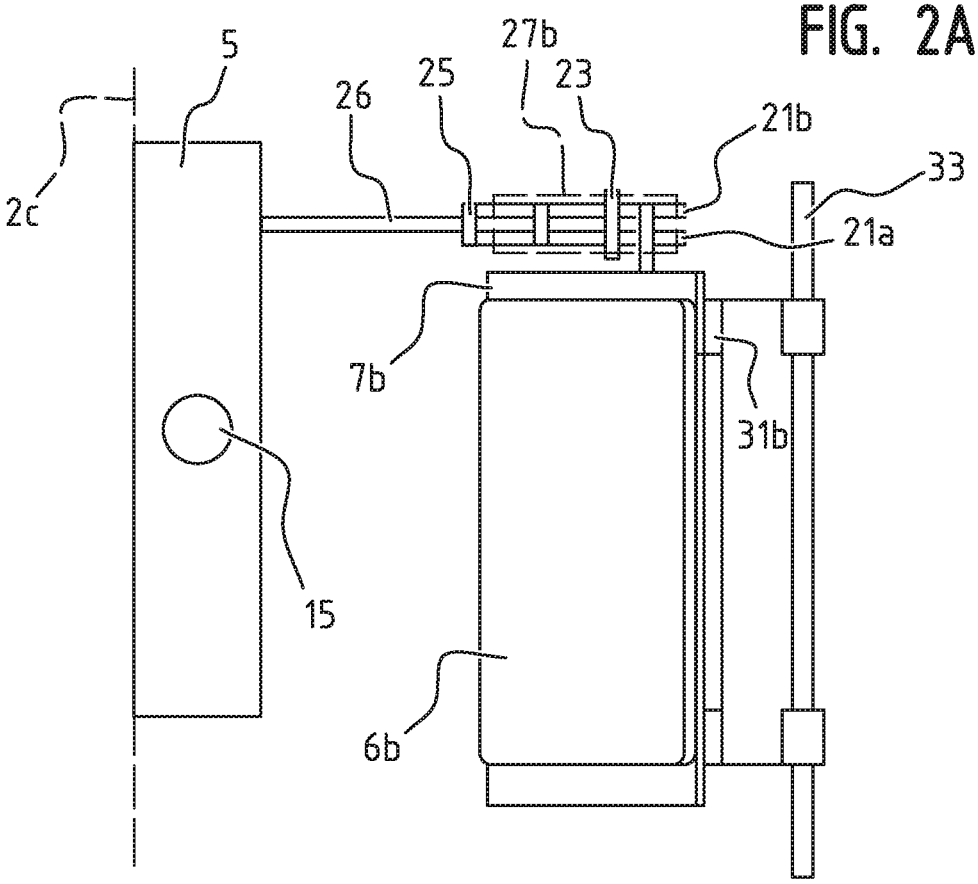

The operation of the mechanism will now be briefly elucidated. In FIGS. 1A-B the system is at rest. The door is closed because bolt 5 hooks into a lock plate (not shown). When flap 3*a* is pressed in with the hand as shown in FIGS. 2A-B, this operation causes scissor arms 21*a*, 21*b* to move toward each other, whereby push part 26 moves in the direction of bolt 5 and thus moves it into the opening position, whereby door 1 is unlocked.

There can be a coupling between bolt 5 and coupling 4, whereby the bolt is held in the locked position, for instance by means of spring means or a magnet. The spring means can be arranged at various positions, for instance also between operating elements 3*a* and 3*b*. Elements 3*a*, 3*b*, 4 and 5 are hereby held in the locked position.

In a possible embodiment the bolt takes a sloping form so that it can tilt from the locked position when the door is moved from an opened position to the closed position. The bolt will not then block the closing but will move independently to the unlocked position, whereby the door can be closed. Immediately after closing, the bias will move the bolt back to the locking position and the bolt drops into the lock plate (not shown).

The invention is not limited to the exemplary embodiments illustrated above, and the skilled person will appreciate that many modifications can be envisaged without departing from the scope of the invention, this scope being defined solely by the following claims.

The invention claimed is:

1. Device for unlocking a door, comprising:

an operating element which is intended to be accessible to a user for the purpose of opening the door and which is mounted tiltably relative to the door;

a bolt movable between a locking position and an opening position of the door;

a coupling which can be placed in the door and which is coupled between the bolt and the operating element for causing a movement of the bolt from the locking position to the opening position upon activation of the operating element, wherein the coupling comprises a pair of scissor arms mounted rotatably around a fixed shaft, and a pair of pivot arms, wherein each pivot arm is connected at a first end for pivoting around a respective first shaft to a respective scissor arm and connected at a second end for pivoting around a second shaft to a push part intended to engage against the bolt, which fixed shaft and first and second shafts are parallel and are intended to extend in a plane substantially parallel to the door, this such that a tilting of the operating element brings about a movement of the push part, which movement of the push part brings about a movement of the bolt.

2. Device as claimed in claim 1, wherein the device further comprises a housing, which housing is intended for insertion into a recess in the door, wherein the fixed shaft is fixedly mounted in the housing and the second shaft is mounted for movement in a guide in the housing.

3. Device as claimed in claim 1, wherein the operating element takes the form of a flap suspended pivotally on one side from the housing, which flap extends in a plane substantially parallel to the fixed shaft and the first and second shafts.

4. Device as claimed in claim 1, comprising a first operating element and a second operating element, which first and second operating elements extend on either side of the coupling and are intended to be built into opposite sides of the door.

5. Device as claimed in claim 4, wherein the first operating element is tiltable around a first tilting shaft and wherein the second operating element is tiltable around a second tilting shaft parallel to the first tilting shaft, the first and second tilting shafts being spring-mounted relative to each other, this such that these tilting shafts are movable toward each other during placing of the device in the door and can move with spring action away from each other for the purpose of positioning the device in the door.

6. Device as claimed in claim 4, further comprising a housing, which housing is intended for insertion into a recess in the door, wherein the fixed shaft is fixedly mounted in the housing and the second shaft is mounted for movement in a guide in the housing, and wherein the first and the second operating elements are each connected by means of a spring-mounted arm to the housing.

7. Device as claimed in claim 6, wherein each spring-mounted arm is connected to a second fixed shaft which is parallel to the fixed shaft around which the pair of scissor arms rotate.

8. Device as claimed in claim 1, wherein the scissor arms are spring-mounted relative to each other such that the spring action moves the scissor arms away from each other.

9. Device as claimed in claim 1, wherein a spring means is provided for the purpose of holding the bolt in the locking position.

10. Device as claimed in claim 1, wherein the operating element is provided with a pin which is arranged such that activation of the operating element carries the coupling from a rest position to an activated position, wherein the scissor arms move toward each other and the pivot arms move toward each other such that the push part moves in the direction of the bolt.

11. Device as claimed in claim 1, wherein each scissor arm is connected at a first end to the first end of the respective pivot arm and is connected at a second end to a press plate, wherein in the activated position the operating mechanism engages against this press plate in order to move the scissor arms toward each other.

12. Device as claimed in claim 1, wherein the device comprises a means to hold the bolt in the locking position.

13. Device for unlocking a door, comprising:

first and second operating elements which are intended to be accessible to a user for the purpose of opening the door and which are mounted tiltably relative to the door;

a bolt movable between a locking position and an opening position of the door;

a coupling which can be placed in the door and which is coupled between the bolt and the first and second operating elements for causing a movement of the bolt from the locking position to the opening position upon activation of either of the first and the second operating element, wherein the coupling comprises a pair of scissor arms mounted rotatably around a fixed shaft, and a pair of pivot arms, wherein each pivot arm is connected at a first end for pivoting around a respective first shaft to a respective scissor arm and connected at a second end for pivoting around a second shaft to a push part intended to engage against the bolt, which fixed shaft and first and second shafts are parallel and are intended to extend in a plane substantially parallel to the door, this such that a tilting of either of the first or the second operating element brings about a movement of the push part, which movement of the push part brings about a movement of the bolt;

wherein the device further comprises a housing, which housing is intended for insertion into a recess in the door, wherein the fixed shaft is fixedly mounted in the housing and the second shaft is mounted for movement in a guide in the housing; and wherein the first and the second operating elements extend on either side of the coupling and are intended to be built into opposite sides of the door.

14. Device as claimed in claim 13, wherein each of the first and the second operating elements takes the form of a flap suspended pivotally on one side from the housing, which flap extends in a plane substantially parallel to the fixed shaft and the first and second shafts.

15. Device as claimed in claim 14, wherein the first operating element is tiltable around a first tilting shaft and wherein the second operating element is tiltable around a second tilting shaft parallel to the first tilting shaft, the first and second tilting shafts being spring-mounted relative to each other, this such that these tilting shafts are movable toward each other during placing of the device in the door and can move with spring action away from each other for the purpose of positioning the device in the door.

16. Device as claimed in claim 14, wherein the first and the second operating element are each connected by means of a spring-mounted arm to the housing.

17. Device as claimed in claim 16, wherein each spring-mounted arm is connected to a second fixed shaft which is parallel to the fixed shaft around which the pair of scissor arms rotates.

18. Device as claimed in claim 13, wherein the scissor arms are spring-mounted relative to each other such that the spring action moves the scissor arms away from each other.

19. Door comprising a device for unlocking a door, comprising:

an operating element which is intended to be accessible to a user for the purpose of opening the door and which is mounted tiltably relative to the door;

a bolt movable between a locking position and an opening position of the door;

a coupling which can be placed in the door and which is coupled between the bolt and the operating element for causing a movement of the bolt from the locking position to the opening position upon activation of the operating element, wherein the coupling comprises a pair of scissor arms mounted rotatably around a fixed shaft, and a pair of pivot arms, wherein each pivot arm is connected at a first end for pivoting around a respective first shaft to a respective scissor arm and connected at a second end for pivoting around a second shaft to a push part intended to engage against the bolt, which fixed shaft and first and second shafts are parallel and are intended to extend in a plane substantially parallel to the door, this such that a tilting of the operating element brings about a movement of the push part, which movement of the push part brings about a movement of the bolt.

20. Door as claimed in claim 19, wherein the bolt is mounted for tilting between a locking position and an opening position in the door around a transverse shaft oriented perpendicularly of the door.

* * * * *